US008256161B2

(12) United States Patent
Nagai et al.

(10) Patent No.: US 8,256,161 B2
(45) Date of Patent: Sep. 4, 2012

(54) AUTOMATIC OPENING/CLOSING APPARATUS FOR VEHICLE

(75) Inventors: Kei Nagai, Kiryu (JP); Hiroki Kuroiwa, Kiryu (JP); Takahisa Miura, Kiryu (JP); Wataru Suzuki, Kiryu (JP); Tsuyoshi Maruyama, Kiryu (JP); Akihiro Kaihatsu, Kiryu (JP)

(73) Assignee: Mitsuba Corporation, Kiryu-shi, Gunma (JP)

( * ) Notice: Subject to any disclaimer, the term of this patent is extended or adjusted under 35 U.S.C. 154(b) by 842 days.

(21) Appl. No.: 11/758,836

(22) Filed: Jun. 6, 2007

(65) Prior Publication Data

US 2008/0000161 A1 Jan. 3, 2008

(30) Foreign Application Priority Data

Jun. 9, 2006 (JP) ..... 2006-160467
Jul. 25, 2006 (JP) ..... 2006-201521

(51) Int. Cl.
*E05F 11/00* (2006.01)

(52) U.S. Cl. ..... 49/360

(58) Field of Classification Search ..... 49/360; 296/155, 146.4; 318/626, 264, 265, 266, 318/272, 275, 282, 286, 466, 467, 468
See application file for complete search history.

(56) References Cited

U.S. PATENT DOCUMENTS 5,410,226 A * 4/1995 Sekiguchi et al. ..... 318/266
6,163,125 A * 12/2000 Bernauer et al. ..... 318/626
6,408,573 B1 * 6/2002 Fukumoto et al. ..... 49/360
7,568,310 B2 * 8/2009 Sato et al. ..... 49/360
2005/0217923 A1 * 10/2005 Onizuka et al. ..... 180/444
2005/0269182 A1 * 12/2005 Hammond et al. ..... 192/84.961
2006/0168891 A1 * 8/2006 Aoyama et al. ..... 49/360
2006/0283089 A1 * 12/2006 Ishihara et al. ..... 49/360
2008/0083168 A1 * 4/2008 Booth et al. ..... 49/360

FOREIGN PATENT DOCUMENTS

DE 44 01 463 A1 7/1994
DE 197 12 185 3/1998

(Continued)

OTHER PUBLICATIONS

European Search Report for Serial No. Ep 07 29 0709 dated Sep. 21, 2007. Office Action issued by Japan Patent Office in related Application No. 2006-201521 on Oct. 18, 2011.

*Primary Examiner* — Katherine w Mitchell
*Assistant Examiner* — Catherine A Kelly
(74) *Attorney, Agent, or Firm* — McCormick, Paulding & Huber LLP

(57) ABSTRACT

An automatic opening/closing apparatus for vehicle including a detected subject and a detection sensor for detecting rotation of an output shaft is downsized. A worm gear mechanism decelerating a rotation speed of an electric motor to output it from the output shaft is accommodated in a gear case, and a drum is fixed to a tip portion of the output shaft projecting from the gear case to the outside, whereby motive power of the output shaft is transmitted from this drum to a sliding door. A concave portion centering at an axial center and recessed in an axial direction is formed in a worm wheel constituting the worm gear mechanism, a magnet unit constituting a rotation sensor is disposed inside the concave portion of the worm wheel, and a magnetic sensor for detecting rotation of the magnet unit is fixed to an inner surface of the gear case.

13 Claims, 5 Drawing Sheets

FOREIGN PATENT DOCUMENTS

| | | | |
|---|---|---|---|
| EP | 0 865 949 | A2 | 12/1997 |
| JP | 7-067293 | A | 3/1995 |
| JP | 10-264660 | | 10/1998 |
| JP | 2000-177391 | | 6/2000 |
| JP | 2000-179233 | | 6/2000 |
| JP | P3253031 | | 11/2001 |
| JP | 2005-083169 | | 3/2005 |
| JP | 2005-321053 | | 11/2005 |
| JP | 2006-022513 | | 1/2006 |

* cited by examiner

AUTOMATIC OPENING/CLOSING APPARATUS FOR VEHICLE

CROSS-REFERENCE TO RELATED APPLICATIONS

Applicant hereby claims foreign priority benefits under U.S.C. §119 from Japanese Patent Applications No. 2006-160467 filed on Jun. 9, 2006 and No. 2006-201521 filed on Jul. 25, 2006, the contents of which are incorporated by reference herein.

TECHNICAL FIELD OF THE INVENTION

The present invention relates to an automatic opening/closing apparatus for vehicle, which automatically opens and closes an opening/closing member provided to a vehicle.

BACKGROUND OF THE INVENTION

Conventionally, there has been known a technology in which an opening/closing member such as a door, window glass, sun roof, or trunk lid provided to a vehicle such as an automobile is automatically opened and closed by an automatic opening/closing apparatus using an electric motor as a driving source. For example, in the automatic opening/closing apparatus that causes a sliding door provided to a side portion of the vehicle to be automatically opened and closed, a cable connected to the sliding door is wound around a drum, and this drum is driven by the electric motor for rotation, thereby causing the sliding door to perform an automatic opening and closing operation.

To the electric motor used in such an automatic opening/closing apparatus, a reduction gear is attached for decelerating rotation of the electric motor to the desired number of rotations. As such a reduction gear, a structure in which a worm gear mechanism is accommodated inside a gear case is often used. The worm gear mechanism includes a worm driven by the electric motor for rotation and a worm wheel engaged with the worm, wherein the rotation of the worm wheel is outputted from an output shaft disposed concentrically with the worm wheel. A tip portion of the output shaft protrudes from the gear case to the outside, and an output member such as the drum as described above is attached to the tip portion, whereby motive power of the output shaft is transmitted to the sliding door through the output member. Further, there has been also known a structure in which an electromagnetic clutch that interrupts motive-power transmission between the worm wheel and the output shaft is accommodated inside the gear case and, with this electromagnetic clutch, the automatic opening/closing apparatus is switched between an automatic opening/closing mode and a manual opening/closing mode.

On the other hand, in such an automatic opening/closing apparatus, the rotation of the output shaft is detected by a rotation sensor, and activation of the electric motor is controlled based on the rotation of the output shaft detected by the rotation sensor. As a rotation sensor, there has been known a structure which includes: a detected subject such as a magnet attached to the output shaft or a member rotating therewith; and a detection sensor such as a magnetic sensor disposed so as to be opposite to the detected subject. For example, Patent Document 1 (Japanese Patent Laid-Open Publication No. 2000-177391) discloses an automatic opening/closing apparatus in which the magnet serving as the detected subject is fixed to an outer circumferential portion of a clutch rotor rotating together with the output shaft and the magnetic sensor serving as the detection sensor is disposed on an outer-radial side of a moving path of the magnet. Also, Patent Document 2 (Japanese Patent Laid-Open Publication No. 2006-22513) discloses the automatic opening/closing apparatus in which the detected subject fixed to the output shaft is disposed outside the gear case and between the gear case and the drum and the detection sensor is disposed on an outer circumferential side of the detected subject.

In such a rotation sensor, the detection sensor outputs a pulse signal with a period proportional to the number of rotations of the detected subject, i.e., the output shaft, and this pulse signal is inputted to a controller. Then, from the period of the inputted pulse signal, the controller detects the number of rotations of the output shaft rotating along with the detected subject, i.e., a moving speed of the sliding door and concurrently totalizes pulse signals using, as a starting point, a time when the sliding door arrives at a reference position (e.g., a fully closed position), thereby detecting the opening/closing position of the sliding door and controlling the activation of the electric motor based on these detection results.

SUMMARY OF THE INVENTION

In the automatic opening/closing apparatus disclosed in Patent Document 1, however, since the detected subject and the detection sensor are accommodated inside the gear case, a waterproof measure is not particularly required. Meanwhile, since the detected subject and the detection sensor are disposed so as to be aligned radially with respect to the clutch rotor, a dimension of the gear case in a diameter direction becomes large. Therefore, the automatic opening/closing apparatus are increased in size.

On the other hand, in the automatic opening/closing apparatus disclosed in Patent Document 2, since the detected subject is disposed so as to be aligned axially with respect to the clutch mechanism or drum, the dimension of the gear case in the diameter direction can be made small. According to a reduction of the dimension of the gear case, however, the dimension of the output shaft in an axial direction is made large, whereby the automatic opening/closing apparatus is increased in size. Also, since the detected subject and the detection sensor are disposed outside the gear case, a waterproof structure against rainwater or the like streaming along the cable and entering therein has to be provided, so that the structure of the automatic opening/closing apparatus becomes complicated. Moreover, in the electromagnetic clutch as disclosed in Patent Document 2, a magnetic flux path is formed via a clutch yoke, a rotor, and an armature by a current flowing in the clutch coil. Also in this structure, the armature of the electromagnetic clutch includes a spline-coupling structure having a base end portion (flange portion) of the output shaft and magnetic bodies connected to each other. In consideration of an influence on the detected subject through the output shaft by the magnetic flux leaked from a coupled location, a detected portion (magnet) of the detected subject is separated away from the output shaft. However, the dimension of the detected subject is radially increased in size, thereby causing a problem in downsizing the automatic opening/closing apparatus.

An object of the present invention is to downsize an automatic opening/closing apparatus for vehicle including a detected subject and a detection sensor for detecting rotation of an output shaft.

An automatic opening/closing apparatus for vehicle according to the present invention is an apparatus, which automatically opens and closes an opening/closing member provided to a vehicle, and comprises: an electric motor provided with a rotating shaft; a worm provided so as to be rotatable integrally with the rotating shaft; a worm wheel provided with a concave portion centering an axial center and recessed in an axial direction, the worm wheel being engaged with the worm in a gear portion provided on an outer circumference of the worm wheel; a gear case accommodating a reduction-gear mechanism constituted by the worm and the worm wheel; an output shaft rotatably supported concentrically with the worm wheel and to the gear case, rotation of the worm wheel being transmitted to the output shaft; an output member fixed to a tip portion of the output shaft projecting outside the gear case to transmit rotation of the output shaft to the opening/closing member; a detected subject located inside the concave portion of the worm wheel and fixed to the output shaft to rotate together with the output shaft; a detection sensor disposed inside the gear case so as to be opposite to the detected subject, and detecting rotation of the detected subject; and control means connected to the electric motor and the detection sensor to control activation of the electric motor based on a detection signal of the detection sensor.

The automatic opening/closing apparatus for vehicle according to the present invention is such that the worm wheel is rotatably supported relatively to the output shaft, and a clutch mechanism interrupting motive-power transmission between the worm wheel and the output shaft is provided inside the gear case.

The automatic opening/closing apparatus for vehicle according to the present invention is such that the output shaft is supported in a state where a position in an axial direction is defined by the gear case, the detected subject includes an annular magnet with a plurality of magnetic poles aligned in a circumferential direction and a disk-shaped main body portion to which the magnet is fixed, and a fixing position of the main body portion to the output shaft is defined by a positioning portion provided to the output shaft, and the detection sensor is fixed to an inner surface of the gear case.

The automatic opening/closing apparatus for vehicle according to the present invention is such that the clutch mechanism includes a driving rotator provided so as to be rotatable integrally with the worm wheel and a driven rotator provided to the output shaft so as to be selectively coupled to the driving rotator, and the driven rotator includes, on an inner diameter side, a connecting member rotating integrally with the output shaft, and the connecting member and the driven rotator are configured so as to be rotatable integrally with each other and movable axially via an linking member.

The automatic opening/closing apparatus for vehicle according to the present invention further comprises: a first engaging portion provided to an end face of the driving rotator in the axial direction; a second engaging portion provided to the driven rotator so as to be opposite to the first engaging portion; and a linking member disposed concentrically with the output shaft and linked to the worm wheel on one side of the linking member in an axial direction and to an outer circumferential edge portion of the driving rotator on the other side thereof, wherein the driven rotator is axially movable between an engaging position where the second engaging portion is engaged with the first engaging portion and a releasing position where an engagement therebetween is released.

The automatic opening/closing apparatus for vehicle according to the present invention is such that the linking member is formed into a cylindrical shape, and the driven rotator is disposed between the worm wheel and the driving rotator and inside the linking member.

The automatic opening/closing apparatus for vehicle according to the present invention further comprises: a clutch coil disposed so as to interpose the driving rotator and be opposite to the driven rotator and generating a magnetic attraction force to cause the driven rotator to move from the releasing position to the engaging position.

The automatic opening/closing apparatus for vehicle according to the present invention is such that the output member is a drum, a cable member connected to the opening/closing member being bridged across the drum, and the opening/closing member being pulled with the cable member so as to perform an opening/closing operation.

According to the present invention, since the detected subject fixed to the output shaft is disposed in the concave portion provided to the worm wheel, the arrangement spaces of the detected subject and the worm wheel in the gear case are overlapped and the dimension of the gear case in an axial direction is reduced. Thereby, the automatic opening/closing apparatus for vehicle provided with the detected subject and the detection sensor can be downsized. Since the detected subject and the detection sensor are both accommodated inside the gear case, a waterproof structure for these members is not required to be provided separately, the structure of this automatic opening/closing apparatus for vehicle can be simplified.

Also, according to the present invention, even when a clutch mechanism is provided inside the gear case, the dimension of the gear case in an axial direction is reduced by overlapping the arrangement spaces of the detected subject and the worm wheel, whereby the automatic opening/closing apparatus for vehicle can be downsized.

Furthermore, according to the present invention, the position of the output shaft in an axial direction is defined by the gear case, the detected subject is fixed to the output shaft in a state of being positioned by the positioning portion provided to the output shaft, and the detection sensor is fixed to the inner surface of the gear case. Therefore, a positional relation between the detected subject and the detection sensor can be defined. Accordingly, an interval between the detected subject and the detection sensor can be set at a predetermined dimension, whereby detection performance of the detection sensor to the detected subject can be enhanced. Also, since the interval between the detected subject and the detection sensor can be narrowed, inexpensive members with low sensitivity can be used as a detection sensor and a detected subject, so that cost of the automatic opening/closing apparatus for vehicle can be reduced.

Still further, according to the present invention, the clutch mechanism is constituted by the driving rotator provided so as to be rotatable integrally with the worm wheel and the driven rotator provided to the output shaft so as to be selectively coupled to the driving rotator. The driven rotator is constituted so as to have, on an inner diameter side, the connecting member rotating integrally with the output shaft and so that the connecting member and the driven rotator are rotatable integrally with each other and movable axially via the linking member. Therefore, even when an electromagnetic clutch mechanism is used as the clutch mechanism, an influence of the magnetic flux of a clutch coil onto the detected subject can be made small.

Still further, according to the present invention, since the worm wheel is linked to the outer circumferential edge portion of the driving rotator by the linking member disposed concentrically with the output shaft, the driven rotator can be disposed between the worm wheel and the driving rotator and a bearing for supporting the output shaft by a housing or the like can be disposed. Therefore, the automatic opening/closing apparatus for vehicle can be downsized without requiring a complicated bearing structure.

Still further, according to the present invention, since the linking member is formed into a cylindrical shape and the driven rotator is disposed between the worm wheel and the driving rotator and inside the linking member, the driven rotator can be supported at a middle portion of the output shaft, whereby the driven rotator can be reliably supported.

Still further, according to the present invention, since the clutch coil disposed so as to interpose the driving rotator and be opposite to the driven rotator is provided, even if an electromagnetic clutch is used as the clutch mechanism, its constitution is simplified, whereby the automatic opening/closing apparatus for vehicle in which this clutch mechanism is used can be downsized.

DESCRIPTION OF THE PREFERRED EMBODIMENTS

Hereinafter, embodiments of the present invention will be described in detail based on the drawings.

Figure 1:
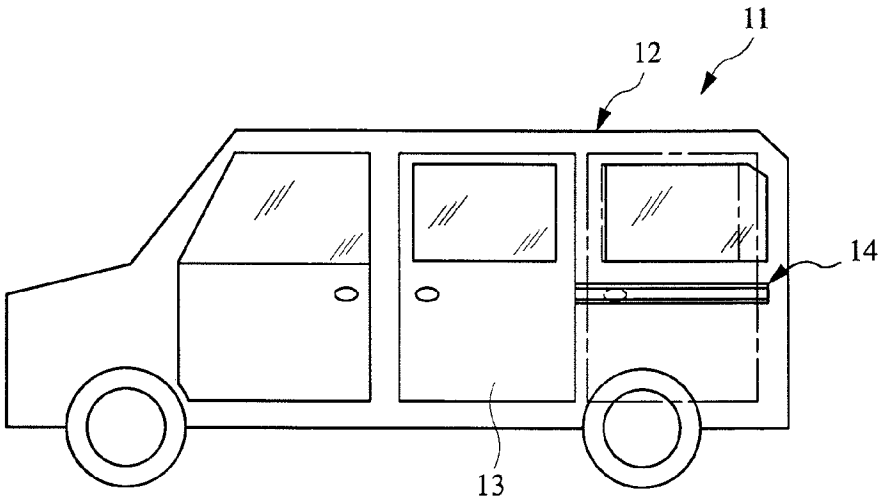
FIG. 1 is a side view showing a one-box type vehicle.
Figure 2:
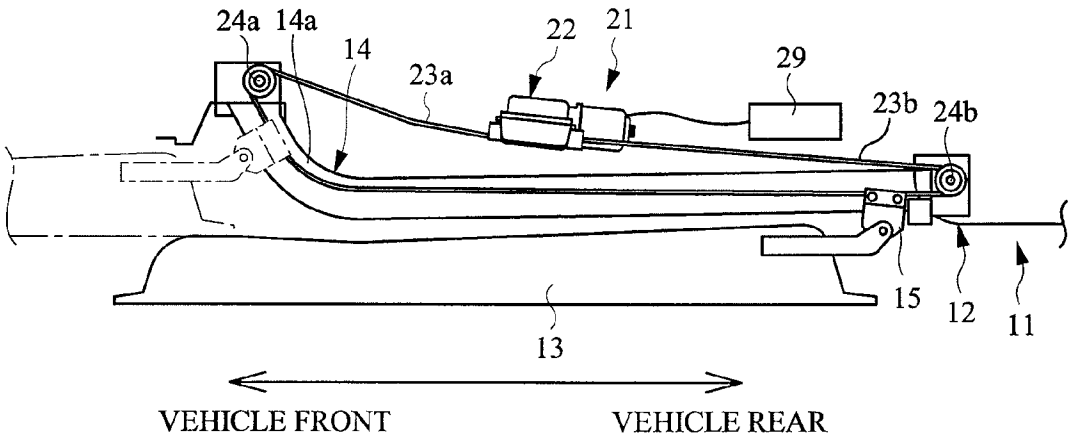
FIG. 2 is a top view showing an automatic opening/closing apparatus for vehicle according to one embodiment of the present invention.

FIG. 1 is a side view showing a one-box type vehicle, and FIG. 2 is a top view showing an automatic opening/closing apparatus for vehicle according to one embodiment of the present invention.

A vehicle 11 shown in FIG. 1 is a one-box type passenger automobile, and a side portion of a vehicle body 12 thereof is provided with a sliding door 13 serving as an opening/closing member. This sliding door 13 moves along a guide rail 14 fixed to the side portion of the vehicle body 12 and is openable/closable between a fully closed position represented by a solid line in FIG. 1 and a fully opened position represented by a one-dot-chain line in FIG. 1. When passengers get in and off and merchandises are loaded and unloaded, the sliding door 13 is opened up to a desirable opening degree.

As shown in FIG. 2, the sliding door 13 is provided with a roller assembly 15. By this roller assembly 15 being guided by the guide rail 14, the sliding door 13 is movable in forward and backward directions of the vehicle 11. Also, a curved portion 14*a* curved toward a vehicle interior side is provided to the guide rail 14 on a vehicle-front side. By the roller assembly 15 being guided by the curved portion 14*a*, the sliding door 13 is closed in a state of being drawn inside the vehicle body 12 so as to fall within the same plane as a side surface of the vehicle body 12. Although not shown, the roller assemblies 15 are also provided to an upper portion and a lower portion located on a front end side of the sliding door 13 in addition to a shown location (center portion). According thereto, there are provided unshown guide rails corresponding to the upper and lower portions located on an opening portion side of the vehicle body 12. Therefore, the sliding door 13 is supported on the vehicle body 12 at three positions.

As shown in FIG. 2, this vehicle 11 is provided with an automatic opening/closing apparatus for vehicle 21 (hereinafter referred to as an opening/closing apparatus 21) to automatically open and close the sliding door 13. The opening/closing apparatus 21 includes a driving unit 22 fixed inside the vehicle body 12 so as to be adjacent to an approximately center portion of the guide rail 14 in vehicle-front and vehicle-rear directions. A closing-side cable 23*a* as a cable member drawn from this driving unit 22 to the vehicle-front side is connected to the roller assembly 15 from the vehicle-rear side (opening side) via a reverse pulley 24*a* provided at a front end of the guide rail 14. An opening-side cable 23*b* as a cable member drawn from the driving unit 22 to the vehicle-rear side is connected to the roller assembly 15 from the vehicle-front side (closing side) via a reverse pulley 24*b* provided at a rear end of the guide rail 14. The driving unit 22 pulls either one of the closing-side cable 23*a* and the opening-side cable 23*b* to cause the sliding door 13 to perform an automatic opening/closing operation by pulling the cable 23*a* or 23*b*.

Figure 3:
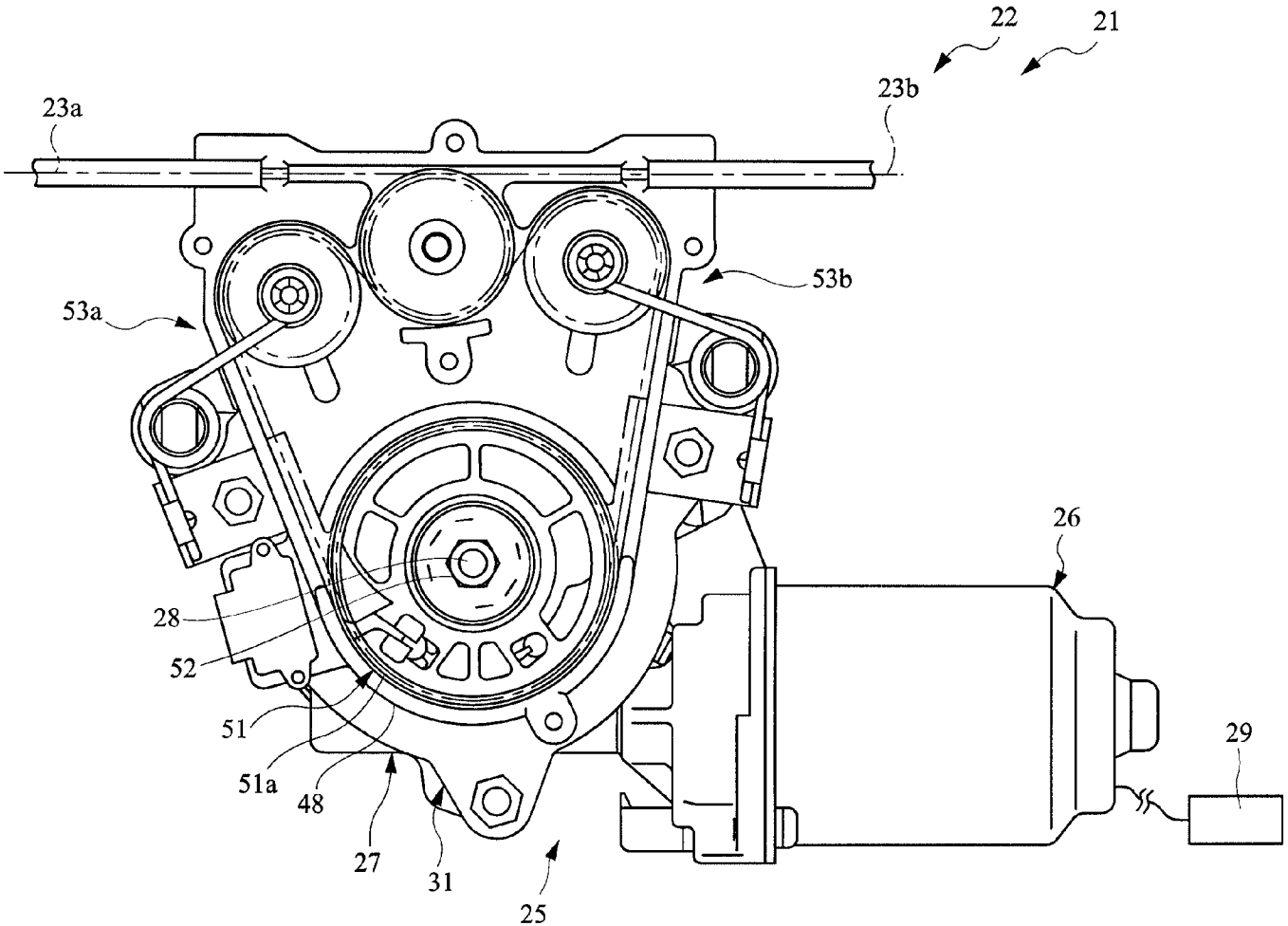
FIG. 3 is a front view showing a detail of a driving unit depicted in FIG. 2.
Figure 4:
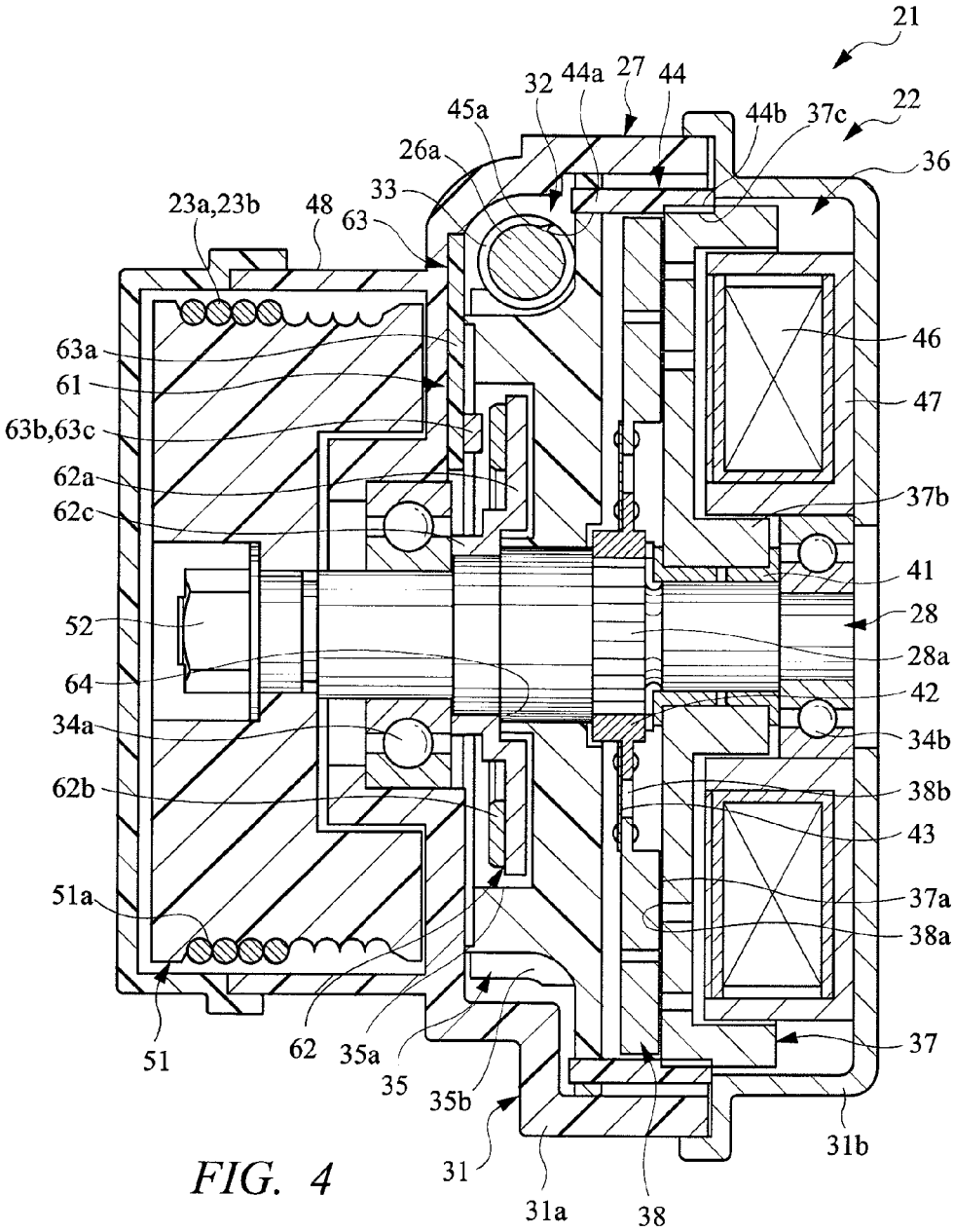
FIG. 4 is a cross-sectional view taken along an output shaft of the driving unit depicted in FIG. 3.

FIG. 3 is a front view showing a detail of the driving unit shown in FIG. 2, and FIG. 4 is a cross-sectional view taken along the output shaft of the driving unit shown in FIG. 3.

As shown in FIGS. 3 and 4, the driving unit 22 has a motor with reduction gear 25, and the motor with reduction gear 25 includes an electric motor 26 and a reduction gear 27 fixed to the electric motor 26. The rotation of the electric motor 26 is decelerated by the reduction gear 27 up to the predetermined number of rotations and is outputted to an output shaft 28. As the electric motor 26, a so-called direct-current motor with brush including a rotating shaft (armature shaft) 26*a* is used, wherein the rotating shaft 26*a* can be rotated in both of forward and backward directions. Also, a controller 29 as control means is connected to the electric motor 26. The activation of the electric motor 26 is controlled by the controller 29 based on an instruction signal from an opening/closing switch not shown.

On the other hand, as shown in FIG. 4, the reduction gear 27 includes: a gear case 31 comprising a case body 31*a* made of a resin and formed into a bus-tub shape and a cover 31*b* made of metal and closing the case body 31*a*; and a worm gear mechanism 32 as a reduction-gear mechanism accommodated inside the gear case 31. In the case shown, a worm 33 forming the worm gear mechanism 32 is integrally provided on an outer circumferential surface of the rotating shaft 26*a* of the electric motor 26 protruding inside the gear case 31. When the rotating shaft 26*a* is rotated, the worm 33 is rotated together with the rotating shaft 26*a*. Also, in the gear case 31, the above-mentioned output shaft 28 is rotatably supported by ball bearings 34*a* and 34*b*. A worm wheel 35 is mounted concentrically with the output shaft 28 and relatively rotatably on the output shaft 28.

This worm wheel 35 is made of a resin material and formed into a disk shape, wherein one end face thereof in an axial direction is provided with a concave portion 35*a*. This concave portion 35*a* is formed into an annular shape, which centers at an axial center of the worm wheel 35 and is recessed axially. When the worm wheel 35 is mounted on the output shaft 28, the concave portion 35*a* is opposite to an inner surface of the gear case 31. Also, a gear portion 35*b* is formed in an outer circumference of the worm wheel 35. The worm wheel 35 is engaged with the worm 33 in the gear portion 35*b* to form the worm gear mechanism 32 together with the worm 33. Thereby, when the electric motor 26 is activated, the rotation speed of the rotating shaft 26*a* is decelerated by the worm gear mechanism 32 up to the predetermined number of rotations and is outputted from the output shaft 28.

Inside the gear case 31, an electromagnetic clutch 36 as a clutch mechanism is accommodated adjacently to the worm gear mechanism 32. The rotation of the worm wheel 35 is transmitted via this electromagnetic clutch 36 to the output shaft 28. That is, by this electromagnetic clutch 36, motive-power transmission between the rotating shaft 26*a* and the output shaft 28 can be interrupted. When the electromagnetic clutch 36 becomes in a motive-power transmission state, the sliding door 13 is in an automatic opening/closing mode of being automatically opened and closed by the electric motor 26. When the electromagnetic clutch 36 becomes in a motive-power cutoff state, the sliding door 13 is in a manual opening/closing mode of being capable of performing manually an opening/closing operation of the sliding door.

This electromagnetic clutch 36 is of a so-called friction type and includes a clutch rotor 37 as a driving rotator and an armature 38 as a rotator to be driven. The clutch rotor 37 is made of steel and is formed into an annular shape with an approximately C-shaped cross section. An axial end face of the clutch rotor 37 directed to a side of a worm wheel 35 is a friction surface 37*a* as a first engaging portion. Also, a boss portion 37*b* is provided on an inner circumferential side of the clutch rotor 37. This boss portion 37*b* of the clutch rotor 37 is relatively rotatably mounted on the output shaft 28 via a sliding bearing 41. The armature 38 is formed into an annular shape having approximately the same diameter as that of the clutch rotor 37, and one end face thereof in an axial direction is a friction surface 38*a* as a second engaging portion. The armature 38 is disposed between the worm wheel 35 and the clutch rotor 37 and aligned in an axial direction with respect to the clutch rotor 37 so that the friction surface 38*a* is opposite to the friction surface 37*a* of the clutch rotor 37 through a slight gap. Also, an annular-shaped connecting member 42 is disposed inside a through hole 38*b* formed in an axial center of the armature 38, and the annular-shaped connecting member 42 is fixed to a serration portion 28*a* formed in a middle portion of the output shaft 28. The armature 38 and the connecting member 42 are linked by a leaf spring 43 as a linking member. The leaf spring 43, the armature 38, and connecting member 42 are fixed by rivets or the like. This leaf spring 43 is formed into a disk shape obtained by punching a steel plate or the like into a predetermined shape, and can be freely elastically deformed in an axial direction and has a predetermined stiffness in a circumferential direction. For this reason, the armature 38 is in a motive-power-transmission possible state between the output shaft 28 and the armature by the leaf spring 43, i.e., is linked so as to be rotated with the output shaft 28. At the same time, the armature 38 can freely move in an axial direction between an engaging position where the friction surface 38*a* is engaged (contacts) with the friction surface 37*a* of the clutch rotor 37 and a releasing position where the engagement is released. That is, when the armature 38 is at the releasing position, the leaf spring 43 is in a natural state without being elastically deformed. When the armature 38 moves to the engaging position, the leaf spring 43 is elastically deformed in the axial direction. Thereby, the armature 38 at the engaging position is biased by a spring force of the leaf spring 43 toward the releasing position. When the armature 38 moves to reach the releasing position, the armature 38 is held by the leaf spring 43 at the releasing position. On the other hand, since the leaf spring 43 has the predetermined stiffness in the circumferential direction, rotation motive power generated between the armature 38 and the output shaft 28 can be transmitted to the armature 38 and the output shaft 28. That is, when the armature 38 is rotated, its rotation is transmitted to the output shaft 28 via the leaf spring 43. When the output shaft 28 is rotated, its rotation is transmitted to the armature 38 via the leaf spring 43.

Figure 5:
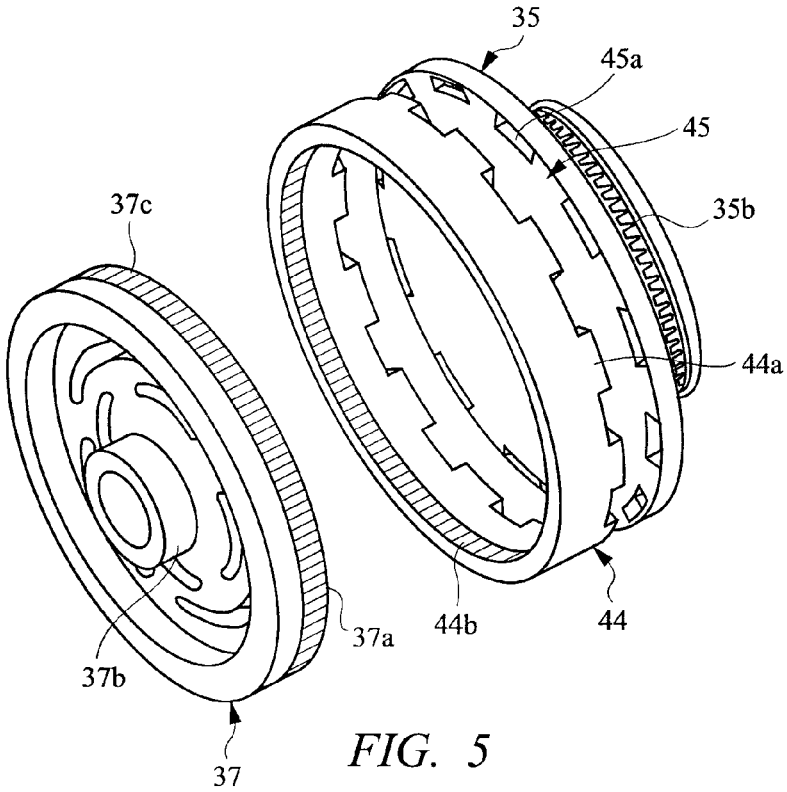
FIG. 5 is an exploded perspective view showing a linking structure of a worm wheel of a rotor ring and a clutch rotor.

FIG. 5 is an exploded perspective view showing a linking structure of a worm wheel of a rotor ring and a clutch rotor, wherein the worm wheel 35 and the clutch rotor 37 is linked by a rotor ring 44 as a linking member.

This rotor ring 44 is made of a resin material having a predetermined stiffness and is formed in a cylindrical shape. One end of the rotor ring 44 in an axial direction is provided with a plurality of engaging protrusions 44*a* aligned in a circumferential direction, whilst a serration portion 44*b* is formed on an inner circumferential surface of the other end thereof in the axial direction. On the other hand, a disk-shaped flange portion 45 is formed in the worm wheel 35. A plurality of engaging holes 45*a* penetrating through the flange portion 45 in an axial direction are formed on an outer circumferential edge portion of the flange portion 45 so as to be aligned in a circumferential direction. When each engaging protrusion 44*a* is inserted in the corresponding engaging hole 45*a* of the worm wheel 35, one end portion side of the rotor ring 44 becomes concentric with the output shaft 28 and, thereby being linked to the outer circumferential edge portion of the worm wheel 35. Also, a serration portion 37*c* is formed in an outer circumferential edge portion of the clutch rotor 37 located on a side of the worm wheel 35. When the serration portion 44*b* is engaged with the serration portion 37*c* of the clutch rotor 37, the other end side of the rotor ring 44 becomes concentric with the output shaft 28 and is linked to the outer circumferential edge portion of the clutch rotor 37. Thereby, the worm wheel 35 and the clutch rotor 37 are linked via the rotor ring 44, and motive power between the worm wheel 35 and the clutch rotor 37 is transmitted via the rotor ring 44.

Also, when the rotor ring 44 is linked to the outer circumferential edge portions of the worm wheel 35 and the clutch rotor 37, the armature 38 is accommodated inside the rotor ring 44. For this reason, the worm wheel 35 and the clutch rotor 37 are linked by the rotor ring 44 on an outer circumferential side of the armature 38, and motive power between the worm wheel 35 and clutch rotor 37 is transmitted by this rotor ring 44 from the outer circumferential side of the armature 38. Therefore, even when the armature 38 is disposed between the worm wheel 35 and the clutch rotor 37 and this armature 38 is fixed to the output shaft 28, there is no need to provide two-stage ball bearings in a diameter direction. Thus, a supporting structure of the output shaft 28, the worm wheel 35, the clutch rotor 37, and the armature 38 can be simplified, and further the electromagnetic clutch 36 and the motor with reduction gear 25 and the opening/closing apparatus 21, which use this electromagnetic clutch 36, can be downsized.

In this manner, in this opening/closing apparatus 21, the worm wheel 35 and the clutch rotor 37 are linked by the cylindrical rotor ring 44, and a motive-power transmission path is provided on the outer circumferential sides of the worm wheel 35 and the clutch rotor 37. Thus, the supporting structure of the output shaft 28, the worm wheel 35, the clutch rotor 37, and the armature 38 can be simplified, and further the electromagnetic clutch 36 and the motor with reduction gear 25 and the opening/closing apparatus 21, which use this electromagnetic clutch 36, can be downsized.

Also, in this opening/closing apparatus 21, the armature 38 is disposed between the worm wheel 35 and the clutch rotor 37 and inside the rotor ring 44. Therefore, the output shaft 28 can support the armature 38 between the paired ball bearings 34*a* and 34*b* supporting the output shaft 28. Thereby, the armature 38 can be reliably supported.

Furthermore, in this opening/closing apparatus 21, when the engaging protrusions 44*a* are inserted into the engaging holes 45*a* of the worm wheel 35 from the axial direction, the rotor ring 44 is movably linked to the worm wheel 35 in an axial direction. Also, when the serration portion 44*b* is engaged with the serration portion 37*c* of the clutch rotor 37 in an axial direction, the rotor ring 44 is movably linked to the worm wheel 35 and the clutch rotor 37 in an axial direction. Incidentally, the worm wheel 35 is disposed rotatably relatively to the output shaft 28 and is made of a resin. Therefore, in the present embodiment, even if the worm wheel 35 slightly moves in the axial direction with respect to the output shaft 28 or if the worm wheel 35 is bent, since the rotor ring 44 is movably linked between the worm wheel 35 and the clutch rotor 37 in the axial direction, a linking state between the worm wheel 35 and the clutch rotor 37 is not released. Also, a stress in the axial direction thereof is absorbed by the rotor ring 44, thereby being not transmitted from the worm wheel 35 to the clutch rotor 37.

Thus, in this opening/closing apparatus 21, since the rotor ring 44 is movably linked in an axial direction to the worm wheel 35 and the clutch rotor 37, a load in the axial direction from the worm wheel 35 to the clutch rotor 37 can be prevented from being applied. Therefore, since the stress in the axial direction is transmitted from the worm wheel 35 to the clutch rotor 37 via the rotor ring 44, it is possible to prevent distortion and the like from being caused in the clutch rotor 37 and enhance activation accuracy of the electromagnetic clutch 36, i.e., the opening/closing apparatus 21.

As shown in FIG. 4, a clutch coil 46 is accommodated inside the gear case 31 so as to be opposite to a rear side of the clutch rotor 37, i.e., to interpose the clutch rotor 37 and be opposite to the armature 38. This clutch coil 46 is wound around a clutch yoke 47 formed into an annular shape with a C-shaped cross section and is opposite to the armature 38 over the entire circumference of the armature 38. Also, the clutch coil 46 is connected to the controller 29 via a wiring not shown. When electric power is supplied from the controller 29, a magnetic force is generated to attract the armature 38 in a direction of approaching to the clutch rotor 37. Therefore, if a current flows in the clutch coil 46 when the armature 38 is at the releasing position, the armature 38 moves from the releasing position to the engaging position and the friction surfaces 37*a* and 38*a* of the clutch rotor 37 and the armature 38 are press-mounted on each other. For this reason, the electromagnetic clutch 36 is switched to a motive-power transmission state, whereby motive power is transmitted between the electric motor 26 and the output shaft 28. On the other hand, if the supply of the current to the clutch coil 46 is stopped, the armature 38 is biased by a spring force of the leaf spring 56 in a direction of separating from the clutch rotor 37 and is held at the releasing position away from the clutch rotor 37. Therefore, the engagement with the clutch rotor 37 and the armature 38 is released, and the electromagnetic clutch 36 becomes in the motive-power cutoff state, and the motive-power transmission between the electric motor 26 and the output shaft 28 is blocked.

Thus, in this opening/closing apparatus 21, since the clutch coil 46 is provided so as to interpose the clutch rotor 37 and be opposite to the armature 38, the structure of this electromagnetic clutch 36 can be simplified, whereby the electromagnetic clutch 36 and the motor with reduction gear 25 and the opening/closing apparatus 21, which use this electromagnetic clutch 36, can be downsized.

A unit case 48 is formed integrally with the case body 31*a*. Inside this unit case 48 (outside the gear case 31), a drum 51 as an output member is accommodated. The drum 51 is fixed by a nut 52 to a tip portion of the output shaft 28 projecting outside the gear case 31 so as to be rotated with the output shaft 28. In a spiral guide groove 51*a* formed in an outer circumferential surface of the drum 51, the closing-side cable 23*a* and the opening-side cable 23*b* are bridged (wound) a plurality of times in the same direction. Respective ends of the cables 23*a* and 23*b* are fixed to the drum 51, and when the drum 51 is driven by the electric motor 26 to be rotated forward or backward, one of the closing-side cable 23*a* and the opening-side cable 23*b* is reeled up by the drum 51, whilst the other is rewound from the drum 51. That is, since the drum 51 is fixed to the output shaft 28 and is also linked to the sliding door 13 via each of the cables 23*a* and 23*b*, the rotation of the output shaft 28 is transmitted to the sliding door 13.

Incidentally, the reference numerals "53*a*" and "53*b*" shown in FIG. 3 denote tensioner mechanisms, whereby predetermined tensions are respectively applied to the cables 23*a* and 23*b* by these tensioner mechanisms 53*a* and 53*b* and prevent an occurrence of slack of the cables 23*a* and 23*b*.

As shown in FIG. 4, a rotation sensor 61 is provided inside the gear case 31 in order to detect the rotation of the output shaft 28. Based on the rotation of the output shaft 28 detected by this rotation sensor 61, the controller 29 controls the activation of the electric motor 26.

Figure 6:
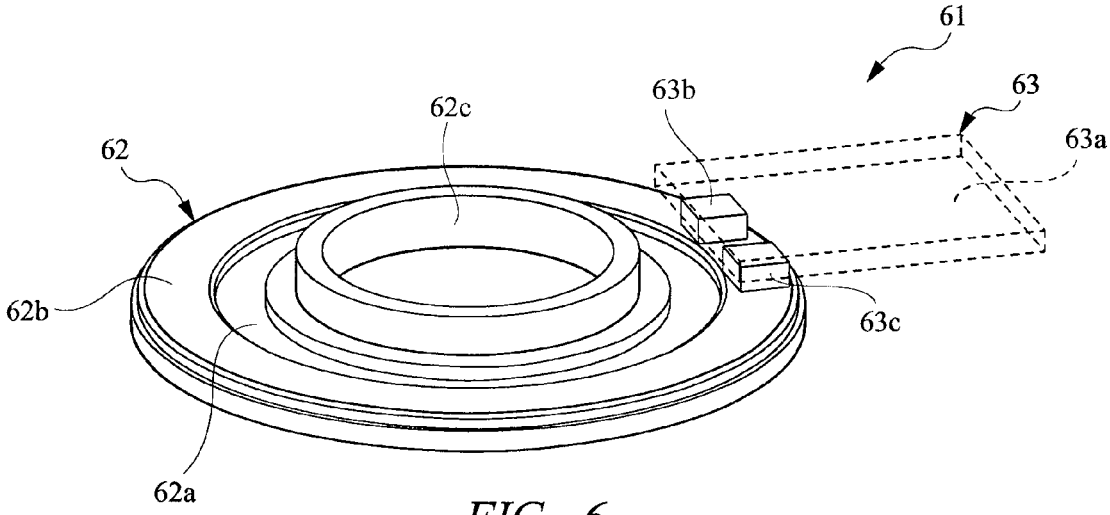
FIG. 6 is a perspective view showing a detail of a rotation sensor.

FIG. 6 is a perspective view showing a detail of the rotation sensor. This rotation sensor 61 includes a magnet unit 62 as a detected subject fixed to the output shaft 28 and a magnetic sensor 63 as a detection sensor.

The magnet unit 62 includes a main body portion 62*a* and a sensor magnet (magnet) 62*b*. The main body portion 62*a* is made of a steel plate and is formed into a disk shape. This main body portion 62*a* is provided integrally with a cylindrical portion 62*c* passing through an axial center of the main body portion. The cylindrical portion 62*c* is fitted in the output shaft 28 from an axial direction, whereby the main body portion 62*a*, i.e., the magnet unit 62 is fixed to the output shaft 28. The output shaft 28 is provided with a step surface 64 as a positioning portion between a portion in which the cylindrical portion 62*c* is fitted and a large-diameter portion larger than this portion. This step surface 64 is formed on a plane perpendicular to the axial direction. When an axial end of the cylindrical portion 62*c* abuts on this step surface 64, the position of the main body portion 62*a* fixed to the output shaft 28 is defined. That is, since the main body portion 62*a* is press-fitted into the output shaft 28 until a position where the axial end of the cylindrical portion 62*c* abuts on the step surface 64, the position of the main body portion 62*a* fixed to the output shaft 28 is defined. Therefore, the sensor magnet 62*b* can be fixed at a predetermined position of the output shaft 28. The main body portion 62*a*, i.e., the magnetic unit 62 fixed to the output shaft 28 is rotated together with the output shaft 28 when the output shaft 28 is rotated.

The sensor magnet 62*b* is an annular-shaped multi-polarized magnet in which a plurality of magnetic poles aligned in a circumferential direction are polarized, and is fixed to one end face of the main body portion 62*a* by adhesive or the like so that an axial center of the sensor magnet 62*b* matches with an axial center of the main body portion 62*a*. Therefore, when the main body portion 62*a* is rotated together with the output shaft 28, the sensor magnet 62*b* is also rotated together with the output shaft 28.

On the other hand, the magnetic sensor 63 has a structure in which a pair of hole elements 63*b* and 63*c* are fixed onto a sensor substrate 63*a*. As shown in FIG. 4, the sensor substrate

63*a* is fixed to an inner surface of the gear case 31 so as to be opposite to an end face of the worm wheel 35 in an axial direction. When the sensor substrate 63*a* is fixed to the inner surface of the gear case 31, each of the hole elements 63*b* and 63*c* is opposite to the sensor magnet 62*b* at a predetermined spaced interval. When the sensor magnet 62*b* is rotated together with the output shaft 28, a pulse signal having a period proportional to the number of rotations is outputted from each of the hole elements 63*b* and 63*c*. Also, the hole elements 63*b* and 63*c* are disposed so as to be shifted to each other in a circumferential direction. Thereby, the periods of the respective pulse signals outputted from the hole elements 63*b* and 63*c* are shifted in phase by 90 degrees. Each of the hole elements 63*b* and 63*c* is connected to the controller 29 via a wiring or the like provided on the sensor substrate 63*a*, and the pulse signals, i.e., detection signals of the hole elements 63*b* and 63*c* are inputted to the controller 29. That is, detection signals of the magnetic sensor 63, which detects the rotation of the output shaft 28 rotated together with the sensor magnet 62*b*, are inputted to the controller 29. From the periods of the inputted pulse signals, the controller 29 detects the number of rotations of the output shaft 28 rotated together with the sensor magnet 62*b*, namely, the moving speed of the sliding door 13, and also totalizes the pulse signals by using, as a starting time, a time when the sliding door 13 arrives at a reference position (e.g., fully closed position), thereby detecting the opening/closing position of the sliding door 13. Based on these detection results, the controller 29 controls the activation of the electric motor 26.

As shown in FIG. 4, the main body portion 62*a* is fixed to the output shaft 28 inside the gear case 31 and on a side of the drum 51 rather than the worm wheel 35. When the main body portion 62*a* is fixed at a predetermined position of the output shaft 28, the magnet unit 62 is located inside the concave portion 35*a* provided in the worm wheel 35. When the electromagnetic clutch 36 becomes in a motive-power cutoff state to cause the worm wheel 35 to be rotatable relatively to the worm wheel 35, the magnet unit 62 located inside the concave portion 35*a* can be rotated relatively to the worm wheel 35. Thereby, even if the magnet unit 62 is disposed inside the gear case 31, the magnet unit 62 is disposed within a range of an arrangement space of the worm wheel 35, namely, the dimensions of the output shaft 28 and the gear case 31 in an axial direction can be reduced by making the arrangement spaces of the magnet unit 62 and the worm wheel 35 overlap. Therefore, even if the rotation sensor 61 is provided inside the gear case 31, the gear case 31 is not made large, thereby making it possible to downsize the opening/closing apparatus 21.

Thus, in the opening/closing apparatus 21, since the magnet unit 62 fixed to the output shaft 28 is disposed in the concave portion 35*a* provided in the worm wheel 35, the dimension of the gear case 31 in the axial direction is reduced, thereby making it possible to downsize the opening/closing apparatus 21.

Also, in the opening/closing apparatus 21, since the rotation sensor 61 is accommodated inside the gear case 31, the rotation sensor 61 can be prevented from being splashed with rainwater or the like, which streams along the cables 23*a* and 23*b*, the drum 51, and the like and enters an interior of the unit case 48. Therefore, the waterproof structure for the rotation sensor 61 is not required to be provided separately, so that the structure of the opening/closing apparatus 21 can be simplified.

Furthermore, in the opening/closing apparatus 21, even if the electromagnetic clutch 36 is provided inside the gear case 31, since the magnetic unit 62 is accommodated in the concave portion 35*a* of the worm wheel 35, the dimension of the gear case 31 in an axial direction is reduced and the opening/closing apparatus can be downsized.

The output shaft 28 is supported to the gear case 31 in a state of being sandwiched between the pair of roll bearings 34*a* and 34*b*, so that the position in an axial direction of the output shaft 28 is defined by the gear case 31. Also, the magnet unit 62 is positioned at the output shaft 28 by the step surface 64, and further the magnetic sensor 63 is fixed to the inner surface of the gear case 31, whereby the axial position of the magnetic sensor 63 to the output shaft 28 is defined. That is, the axial positions of the sensor magnet 62*b* and the magnetic sensor 63 are defined by the gear case 31 and the output shaft 28, respectively. Therefore, an interval between each of the hole elements 63*b* and 63*c* of the magnetic sensor 63 and the sensor magnet 62*b* can be set at a defined dimension, whereby detection performance of the magnetic sensor 63 can be enhanced.

Thus, in the opening/closing apparatus 21, the position of the output shaft 28 in an axial direction is defined by the gear case 31, the magnet unit 62 is fixed to the output shaft 28 in a state of being positioned by the step surface 64 provided to the output shaft 28, and the magnetic sensor 63 is fixed to the inner surface of the gear case 31. Accordingly, an axial positional relation between the magnet unit 62 and the magnetic sensor 63 can be accurately defined. Therefore, since the interval between the magnet unit 62 and the magnetic sensor 63 can be set so as to decrease, the detection performance of the magnetic sensor 63 can be enhanced. Still further, since the interval between the magnet unit 62 and the magnetic sensor 63 can be narrowed, cost of the opening/closing apparatus 21 can be reduced by using the inexpensive hole elements 63*b* and 63*c* with low sensitivity as the detection sensor 63 or using an inexpensive magnet with a low magnetic force as the sensor magnet 62*b*.

Next, the activation of the opening/closing apparatus 21 will be briefly described.

For example, when a closing side of an opening/closing switch not shown is operated and an instruction signal for activating the sliding door 13 in a closing direction is inputted, a current flows in the clutch coil 46 to form a magnetic flux path via the clutch yoke 47, the clutch rotor 37, and the armature 38. Thereby, the armature 38 is attracted to the clutch rotor 37 to cause the electromagnetic clutch 36 to be switched to a motive-power transmission state. At this time, since the armature 38 and the connecting member 42 are linked via the leaf spring 43, a leakage of the magnetic flux from this linked location can be reduced. Next, when the electric motor 26 is activated in a forward rotating direction, the drum 51 is rotated in a counterclockwise direction of FIG. 3. For this reason, the closing-side cable 23*a* is reeled up by the drum 51, and the sliding door 13 is pulled by the closing-side cable 23, thereby moving toward the fully closed position. Conversely, when an opening side of the opening/closing switch is operated and an instruction signal for activating the sliding door 13 in an opening direction is inputted in the controller 29, the electric motor 26 is rotated in reverse and the drum 51 is rotated in a clockwise direction of FIG. 3. For this reason, the opening-side cable 23*b* is reeled up by the drum 51, and the sliding door 13 is pulled by the opening-side cable 23*b*, thereby moving toward the fully opened position. When the sliding door 13 arrived at the fully opened or closed position or when the opening/closing switch is operated to stop, the electric motor 26 is stopped. Then, the electromagnetic clutch 36 is switched to a cutoff state, whereby the automatic opening/closing operation is terminated.

On the other hand, when the electromagnetic clutch 36 is switched to a motive-power cutoff state while the electric motor 36 is stopped, the opening/closing apparatus 21 becomes in a manual opening/closing mode, so that a opening/closing control force of the sliding door 13 by hand can be reduced.

Figure 7:
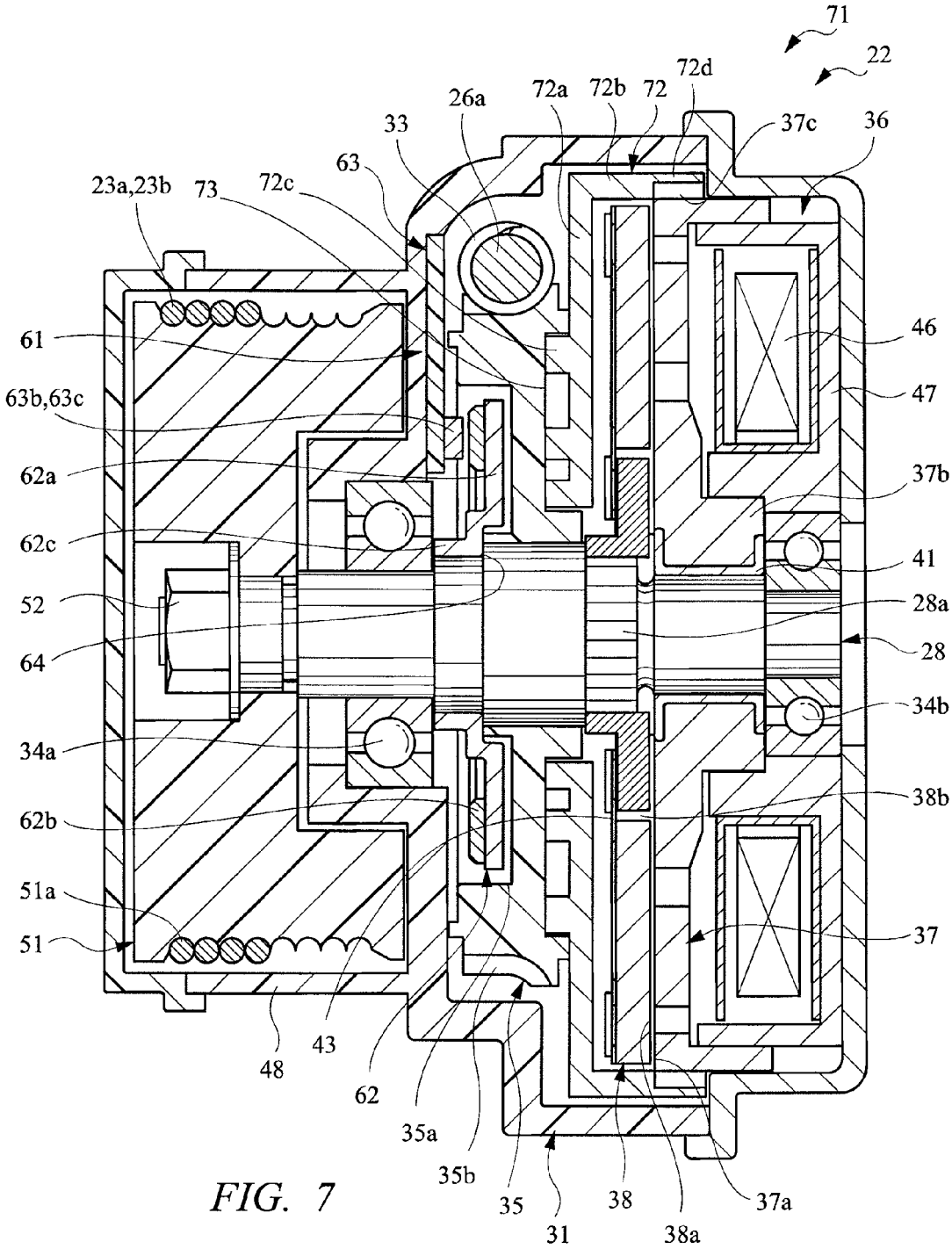
FIG. 7 is a cross-sectional view showing a modification example of an opening/closing apparatus depicted in FIG. 4.

FIG. 7 is a cross-sectional view showing a modification example of the opening/closing apparatus shown in FIG. 4.

In the opening/closing apparatus 21 shown in FIG. 4, the rotor ring 44 formed into a cylindrical shape is axially movably linked to the outer circumferential edge portions of the worm wheel 35 and the clutch rotor 37, whereby the motive power of the worm wheel 35 is transmitted to the clutch rotor 37 via this rotor ring 44. By contrast, in an automatic opening/closing apparatus for vehicle 71 (hereinafter referred to an opening/closing apparatus 71) shown in FIG. 7, a rotor ring 72 is formed into a cylindrical, bottomed shape in which an annular disk portion 72*a* disposed so as to be aligned with the worm wheel 35 in an axial direction and a cylindrical portion 72*b* projecting from an outer circumferential portion of the disk portion 72*a* in an axial direction are integrally formed. Thereby, a plurality of annular engaging protrusions 72*c* provided on the disk portion 72*a* engaged, from an axial direction, with an engaging concave portion 73 formed at an end face of the worm wheel 35 in an axial direction, so that the rotor ring 72 is rotatably linked integrally with the worm wheel 35. Also, the cylindrical portion 72*b* is disposed outside the armature 38, and a serration portion 72*d* provided to an end of the rotor ring 72 in an axial direction is engaged with a serration portion 37*c* of the clutch rotor 37 from an axial direction, so that the rotor ring 72 is linked to the outer circumferential edge portion of the clutch rotor 37. By such a structure, the motive power from an outside of the armature 38 via the rotor ring 72 is transmitted between the worm wheel 35 and the clutch rotor 37.

Also in the opening/closing apparatus 71, the concave portion 35*a* centering at the axial center and recessed axially is formed in the worm wheel 35. The magnet unit 62 constituting the rotation sensor 61 is fixed to the output shaft 28 so as to be positioned inside this concave portion 35*a*.

Figure 8:
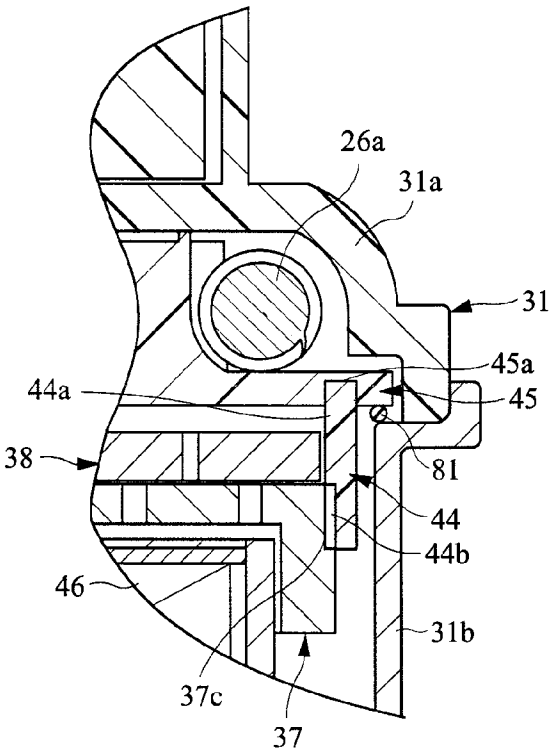
FIG. 8 is an enlarged cross-sectional view showing a modification example of the linking structure of the worm wheel and the rotor ring.

FIG. 8 is an enlarged cross-sectional view showing a modification example of a linking structure between the worm wheel and the rotor ring.

In the opening/closing apparatus 21 shown in FIG. 4, the plurality of engaging holes 45*a* provided on the outer circumferential edge portion of the flange portion 45 of the worm wheel 35 are formed as through holes penetrating through the flange portion 45 in an axial direction. However, the present invention is not limited to this structure. Alternatively, as shown in FIG. 8, engaging holes 45*a* of the worm wheel 35 may be each formed into a concave shape not penetrating through the flange portion 45. Thus, since the engaging holes 45*a* are each formed into a concave shape, lubricating oil such as grease applied to the worm gear mechanism 32 is prevented from entering a side of the clutch rotor 37 or armature 38 via the engaging holes 45*a*, whereby activating reliability of the electromagnetic clutch 36 can be enhanced. Also, a sealing member 81 made of rubber or the like may be mounted between the flange portion 45 of the worm wheel 35 and the gear case 31 to prevent grease from entering a side of the clutch rotor 37 or armature 38 from between the worm wheel 35 and the gear case 31.

Incidentally, in FIGS. 7 and 8, the same reference numerals are denoted to members corresponding to those described above.

The present invention is not limited to the embodiment described above and, needless to say, may be variously modified within a scope of not departing from the gist thereof. For example, although the opening/closing member is assumed in the present embodiment to be the sliding door 13 opened and closed in a sliding manner, the present invention is not limited to this structure. Alternatively, there may be used another opening/closing member such as a hinge-type horizontally opening/closing door for incoming/outgoing or a back door provided at the vehicle-rear end portion.

Also in the present embodiment, a multi-polarized magnet formed into an annular shape is used as the sensor magnet 62*b*, and the magnetic sensor 63 always is opposite to the sensor magnet 62*b*. However, the present invention is not limited to this structure. Alternatively, a magnet with a rectangular, circular, or another shape may be used as the sensor magnet 62*b*, and the sensor magnet 62*b* may be opposite to the magnetic sensor 63 only when the output shaft 28 arrives at a predetermined rotating position.

Furthermore, in the present embodiment, the rotation sensor 61 provided with the magnet unit 62 as a detected subject and the magnetic sensor 63 as a detection sensor is used. However, the present invention is not limited to this structure. For example, there may be used another type of rotation sensor such as one including a disk provided with a slit and an optical sensor.

Still further, in the present embodiment, the magnetic sensor 63 is fixed to the inner surface of the gear case 31 so as to be opposite axially to the sensor magnet 62*b* of the magnet unit 62 disposed in the concave portion 35*a* of the worm wheel 35. However, the present invention is not limited to this structure. For example, the magnetic sensor 63 may stand from the inner surface side of the gear case 31 so as to be positioned on an outer circumferential side of the sensor magnet 62*b* in the concave portion 35*a* of the worm wheel 35.

Still further, in the present embodiment, the worm 33 is provided integrally with the outer circumferential surface of the rotating shaft 26*a* of the electric motor 26. However, the present invention is not limited to this structure. Alternatively, the worm 33 may be press-fitted in and fixed to the rotating shaft 26*a*. Still alternatively, a shaft for the worm 33 may be provided separately from the rotating shaft 26*a* to provide the worm 33 to this shaft.

Still further, in the present embodiment, the rotor ring 44 is made of a resin, but the present invention is not limited to this structure. Alternatively, the rotor ring 44 may be formed into a cylindrical shape by rolling and processing a steel plate or the like.

Still further, in the present embodiment, the armature 38 is linked in a state of being able to transmit motive power to the output shaft 28 via the connecting member 42 and the leaf spring 43. However, the present invention is not limited to this structure. Alternatively, by spline-coupling the armature 38 and the connecting member 42, the motive power may be transmitted directly between these two members without interposing the leaf spring 43. Still alternatively, by omitting also the leaf spring 43, the armature 38 and the connecting member 42 may be coupled only through spline. In this case, if a structure is such that the engagement between the clutch rotor 37 and the armature 38 is released when no current flows in the clutch coil 46, the clutch rotor 37 and the armature 38 can be always in a slidable contact state when no current flows in the clutch coil 46.

Still further, in the present embodiment, a friction-type electromagnetic clutch is used as the electromagnetic clutch 36. However, the present invention is not limited to this structure. Alternatively, there may be used another type of electromagnetic clutch such as an engaging type.

What is claimed is:

1. An automatic opening and closing apparatus which automatically opens and closes an opening and closing member provided in a vehicle, the apparatus comprising:

an electric motor provided with a rotating shaft;

a worm provided so as to be rotatable integrally with the rotating shaft;

a worm wheel provided with a cylindrical concave portion that has an open end and a closed end, wherein the concave portion has an axial center and is recessed in an axial direction, and wherein the worm wheel is engaged with the worm in a gear portion provided on an outer circumference of the worm wheel;

a gear case accommodating a reduction-gear mechanism constituted by the worm and the worm wheel;

an output shaft rotatably supported concentrically with the worm wheel and the gear case, wherein the worm wheel is rotatably supported relative to the output shaft and rotation of the worm wheel is transmitted to the output shaft;

an output member fixed to a tip portion of the output shaft projecting outside the gear case to transmit rotation of the output shaft to the opening and closing member;

a detection sensor disposed inside the gear case so as to be opposite to a magnet provided on a disk-shaped plate, and configured to detect rotation of the magnet, wherein the disk-shaped plate is fixed directly to the output shaft to rotate together with the output shaft, and wherein the magnet and disk-shaped plate are located inside the concave portion between the open end and the closed end; and control means connected to the electric motor and the detection sensor, wherein the control means is adapted to control activation of the electric motor based on a detection signal of the detection sensor.

2. The automatic opening and closing apparatus according to claim 1, wherein a clutch mechanism interrupting motive-power transmission between the worm wheel and the output shaft is provided inside the gear case.

3. The automatic opening and closing apparatus according to claim 1, wherein the output shaft is supported in a position such that the output shaft is aligned along an axis defined by the gear case, wherein the magnet includes an annular magnet with a plurality of magnetic poles aligned in a circumferential direction and a disk-shaped main body portion to which the magnet is fixed, and a fixing position of the main body portion to the output shaft is defined by a positioning portion provided to the output shaft, and wherein the detection sensor is fixed to an inner surface of the gear case.

4. The automatic opening and closing apparatus according to claim 2, wherein the output shaft is supported in a position such that the output shaft is aligned along an axis defined by the gear case, wherein the magnet includes an annular magnet with a plurality of magnetic poles aligned in a circumferential direction and a disk-shaped main body portion to which the magnet is fixed, and a fixing position of the main body portion to the output shaft is defined by a positioning portion provided to the output shaft, and wherein the detection sensor is fixed to an inner surface of the gear case.

5. The automatic opening and closing apparatus according to claim 2, wherein the clutch mechanism includes a driving rotator provided so as to be rotatable integrally with the worm wheel and a driven rotator provided to the output shaft so as to be selectively coupled to the driving rotator, and wherein the driven rotator includes, on an inner diameter side, a connecting member rotating integrally with the output shaft, and the connecting member and the driven rotator are configured so as to be rotatable integrally with each other and movable axially via a first linking member.

6. The automatic opening and closing apparatus according to claim 4, wherein the clutch mechanism includes a driving rotator provided so as to be rotatable integrally with the worm wheel and a driven rotator provided to the output shaft so as to be selectively coupled to the driving rotator, and wherein the driven rotator includes, on an inner diameter side, a connecting member rotating integrally with the output shaft, and the connecting member and the driven rotator are configured so as to be rotatable integrally with each other and movable axially via a first linking member.

7. The automatic opening and closing apparatus according to claim 5, further comprising:

a first engaging portion provided to an end face of the driving rotator in an axial direction;

a second engaging portion provided to the driven rotator so as to be opposite to the first engaging portion; and a second linking member disposed concentrically with the output shaft and linked to the worm wheel on one side of the second linking member in the axial direction and to an outer circumferential edge portion of the driving rotator on the other side thereof, wherein the driven rotator is axially movable between an engaging position where the second engaging portion is engaged with the first engaging portion and a releasing position where an engagement therebetween is released.

8. The automatic opening and closing apparatus according to claim 6, further comprising:

a first engaging portion provided to an end face of the driving rotator in the axial direction;

a second engaging portion provided to the driven rotator so as to be opposite to the first engaging portion; and a second linking member disposed concentrically with the output shaft and linked to the worm wheel on one side of the second linking member in the axial direction and to an outer circumferential edge portion of the driving rotator on the other side thereof, wherein the driven rotator is axially movable between an engaging position where the second engaging portion is engaged with the first engaging portion and a releasing position where an engagement therebetween is released.

9. The automatic opening and closing apparatus according to claim 7, wherein the first linking member is cylindrical in shape, and wherein the driven rotator is disposed between the worm wheel and the driving rotator and inside the first linking member.

10. The automatic opening and closing apparatus according to claim 8, wherein the first linking member is cylindrical in shape, and wherein the driven rotator is disposed between the worm wheel and the driving rotator and inside the first linking member.

11. The automatic opening and closing apparatus according to claim 9, further comprising:

a clutch coil disposed so as to interpose the driving rotator and be opposite to the driven rotator and generating a magnetic attraction force to cause the driven rotator to move from the releasing position to the engaging position, wherein the driving rotator is arranged on the opposite side of the surface of the worm wheel where the concave portion is formed; and wherein the clutch coil is arranged on the opposite side of the driven rotator and against the driving rotator.

12. The automatic opening and closing apparatus according to claim 10, further comprising:

a clutch coil disposed so as to interpose the driving rotator and be opposite to the driven rotator and generating a magnetic attraction force to cause the driven rotator to move from the releasing position to the engaging position, wherein the driving rotator is arranged on the opposite side of the surface of the worm wheel where the concave portion is formed; and wherein the clutch coil is arranged on the opposite side of the driven rotator and against the driving rotator.

13. The automatic opening and closing apparatus according to claim 1, wherein the output member is a drum, a cable member connected to the opening and closing member being bridged across the drum, and the opening and closing member being pulled with the cable member so as to perform an opening and closing operation.

* * * * *